US005598676A

United States Patent [19]

Chaves

[11] Patent Number: 5,598,676

[45] Date of Patent: Feb. 4, 1997

[54] HEARTH FORM FOR POUR-FORMING A FIREPLACE HEARTH

[76] Inventor: Damien E. Chaves, 9331 Old Burke Lake Rd., Burke, Va. 22015

[21] Appl. No.: 480,710

[22] Filed: Jun. 7, 1995

[51] Int. Cl.[6] ..... E04B 1/343; E04B 1/16

[52] U.S. Cl. ..... 52/326; 52/105; 52/335; 52/414; 52/749.13; 126/500; 249/1; 249/189

[58] Field of Search ..... 52/105, 320, 326, 52/335, 414, 749.13; 126/500, 540, 541, 542, 543, 554, 555; 248/496, 497, 498; 249/1, 13, 17, 188, 189; D23/343, 344, 345

[56] References Cited

U.S. PATENT DOCUMENTS

| | | | |
|---|---|---|---|
| 4,216,597 | 8/1980 | Kocina et al. | 248/496 X |
| 5,010,874 | 4/1991 | Toth | 126/543 |

FOREIGN PATENT DOCUMENTS

| | | | |
|---|---|---|---|
| 7221 | 9/1842 | France | 126/500 |
| 9768 | of 1912 | United Kingdom | 126/500 |
| 201196 | 7/1923 | United Kingdom | 126/500 |
| 511428 | 8/1939 | United Kingdom | 126/500 |

*Primary Examiner*—Carl D. Friedman
*Assistant Examiner*—Kevin D. Wilkens
*Attorney, Agent, or Firm*—Diller, Ramik & Wight PC

[57] ABSTRACT

A hearth form is utilized for pour-forming a fireplace hearth in the absence of eventual removal thereof from an opening established by floor joists and a conventional concrete masonry unit. The hearth form is preferably constructed from two relatively slidable body portions which may be reinforced by inter-engaged parallel channels or grooves. The body portions collectively define a chamber or cavity into which concrete can be poured. A peripheral wall defined in part by side walls and front walls carry brackets for establishing a predetermined space between the hearth form and floor joists, not just for supporting the hearth form upon nails or fasteners and nail centering marks for establishing the location of fasteners to assemble the hearth form in an associated floor opening.

27 Claims, 3 Drawing Sheets

HEARTH FORM FOR POUR-FORMING A FIREPLACE HEARTH

BACKGROUND OF THE INVENTION

It is common practice to build fireplaces in homes and build concrete hearths in association with such fireplaces. A concrete masonry unit (CMU) is first constructed utilizing cinder blocks which are mortared into a desired peripheral configuration and the interior thereof is generally filled with brick trash, masonry fill, etc. The concrete masonry unit is built in a floor opening defined by double floor joists. Building codes require that the double floor joists be spaced from the exterior surfaces of the concrete masonry unit to prevent heat from a fire in the eventual completed fireplace from actually burning the floor joists, associated underflooring, debris, etc., and burning down the associated building. At this point in the construction of the fireplace hearth, the concrete masonry unit is spaced from the floor joists by whatever distance is prescribed by the local code, but a form must be built to allow the pouring of the concrete hearth. Conventionally the hearth form is built from wood, appropriately nailed and supported in an area between what will be the front of the fireplace between a front of the concrete masonry unit and the adjacent double floor joists. This wooden hearth form is not, of course, built with any degree of accuracy or reliability and basically serves as a temporary support for the eventually poured concrete. If the carpenter does not build the wooden hearth form correctly and accurately, the spacing eventually created upon the setting of the concrete and removal of the wooden hearth form might not meet the code which in turn would require the concrete hearth to be destroyed, reformed and rebuilt. If the wooden hearth form has gaps or spaces that are not filled by the poured concrete, these can conduct heat outwardly toward the double floor joists, the underfloor, and any scrap materials in the area creating a fire hazard. Likewise, the wooden hearth form must be removed because it is itself a fire danger because of its natural combustibility, and if all or part thereof is not removed, the danger of unintended fire-damage is increased. From the foregoing, such conventional on-site built wooden hearth forms are unreliable. unsafe and costly.

SUMMARY OF THE INVENTION

In keeping with the foregoing known disadvantages of prior art wooden hearth forms, the present invention provides a hearth form for pour-forming a fireplace hearth which includes a body constructed of substantially fire-proof material and which defines a chamber or cavity into which concrete can be poured. The body includes a plurality of spacing and securing brackets or hangers which secure the body in an opening of an associated floor structure within which the fireplace hearth is to be pour-formed. After the concrete has been poured into the hearth form and has set, nothing further need be done and the fireplace hearth and the fireplace can then be built in a conventional fashion. Since the hearth form is constructed from fire-proof material, it need not be removed and the brackets or hangers thereof assure that the spacing required by the code is provided accurately and reliably. Thus, the hearth form has no disadvantages associated with human construction errors.

In further accordance with the present invention, the body of the hearth form is preferably constructed from at least two body portions which are provided with one or more channels and/or grooves to permit slidable adjustment therebetween.

Thus a single hearth form can be utilized for a variety of different sized hearths.

In further accordance with this invention, the hangers or brackets are provided with nail centering marks which accurately locate the position at which nails or similar fasteners are to be driven into the double floor joists defining the floor opening within which the hearth form is supported. These brackets also include downwardly diverging opening notches which seat upon such nails or like fasteners to rigidly support the hearth form within the floor opening and maintain the same therein in a reliable fashion during the pouring and setting of the concrete. With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figure 1:
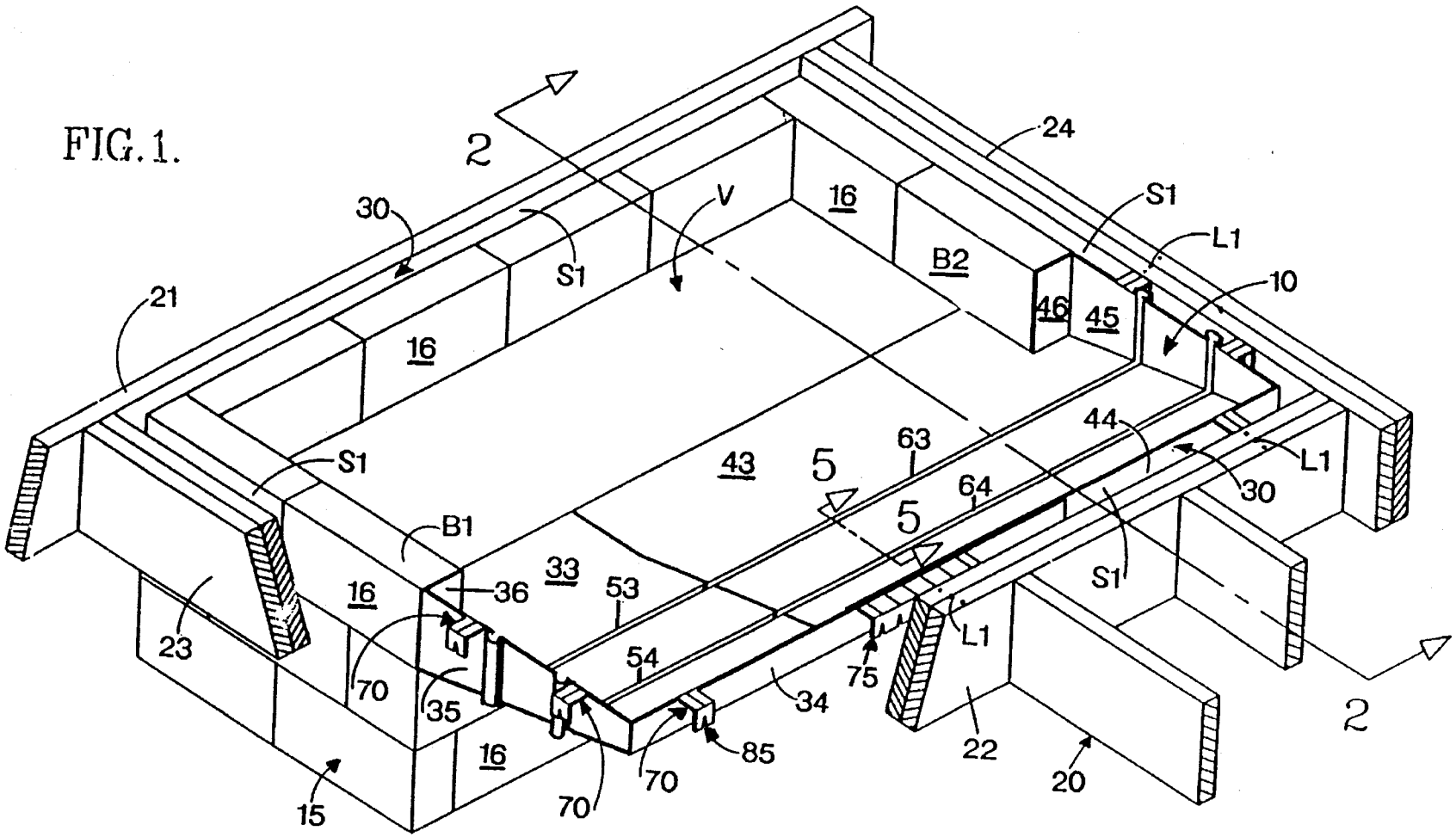
FIG. 1 is a perspective view of a novel hearth form of the present invention, and illustrates the hearth form positioned in association with a concrete masonry unit (CMU) and an opening formed by double floor joists of an associated building.
Figure 4:
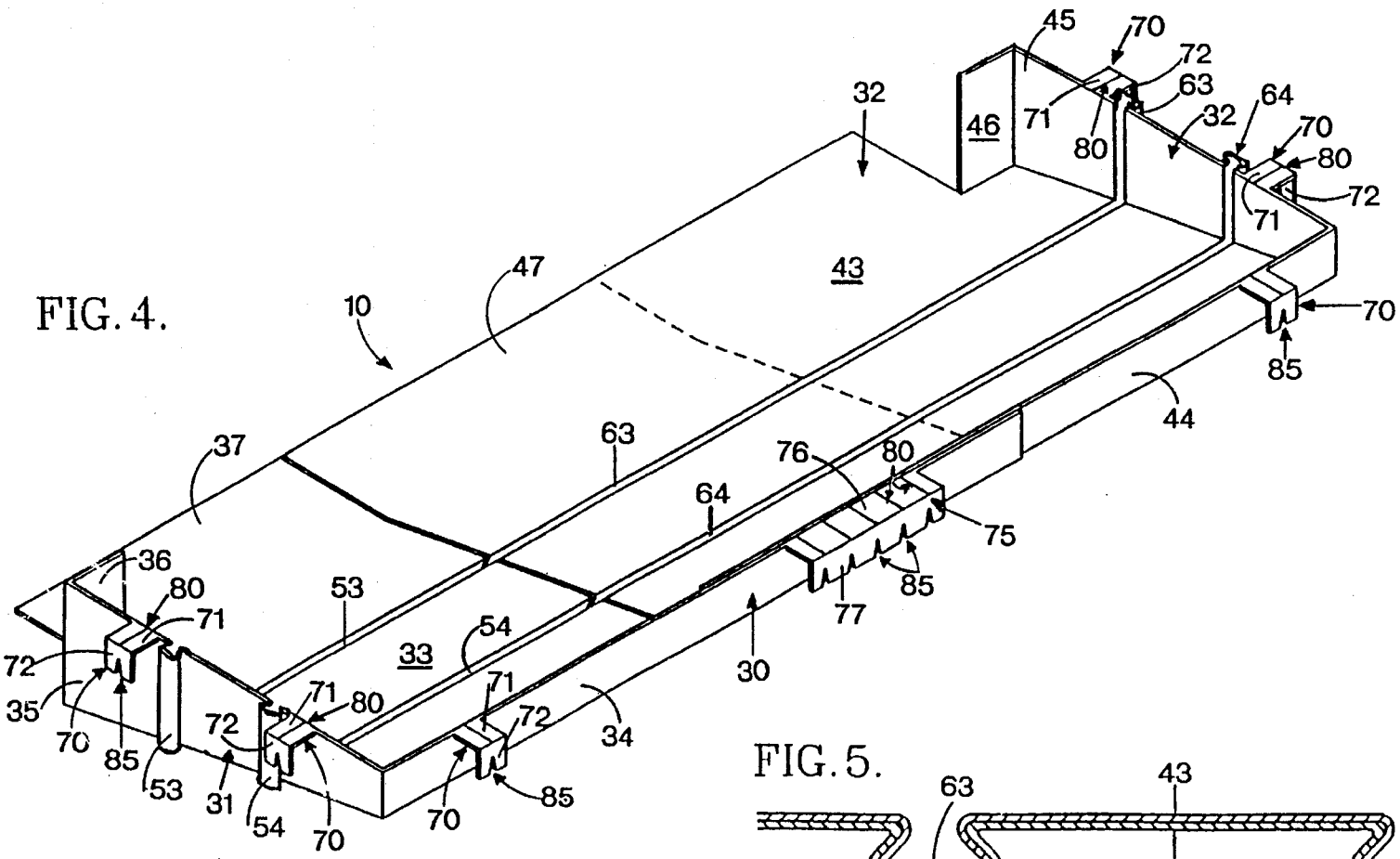
FIG. 4 is a perspective view of the hearth form of FIG. 1, and illustrates the details thereof including a pair of body portions having telescopically united ribs, grooves and/or channels and spacing and suspending hangers or brackets with associated nail centering marks and notches.

A novel hearth form for pour-forming a fireplace hearth is best illustrated in FIGS. 1 and 4 of the drawings and is generally designated by the reference numeral 10.

Referring first to FIG. 1, the hearth form 10 is illustrated in its position of use in association with a concrete masonry unit (CMU) 15 and a floor 20.

The floor 20 is of a conventional construction and includes a single (or double) rear floor joist 21, front double floor joists 22 parallel to the rear floor joist 21 and opposite side double floor joists 23, 24. The floor joists 21–24 define a generally rectangular area or opening 30 which surrounds the concrete masonry unit 15 in spaced relationship thereto with the space therebetween being generally designated by the reference character S1. The space S1 is dictated by housing or building codes and is intended to prevent heat conducted from the fire in the eventually built fireplace from adversely effecting (burning) the floor 20, the joists 21 - 24 associated therewith, underflooring (not shown) or any debris which may be in the environs of the floor 20 and the concrete masonry unit 15, as is not uncommon in conventional building structures.

Figure 2:
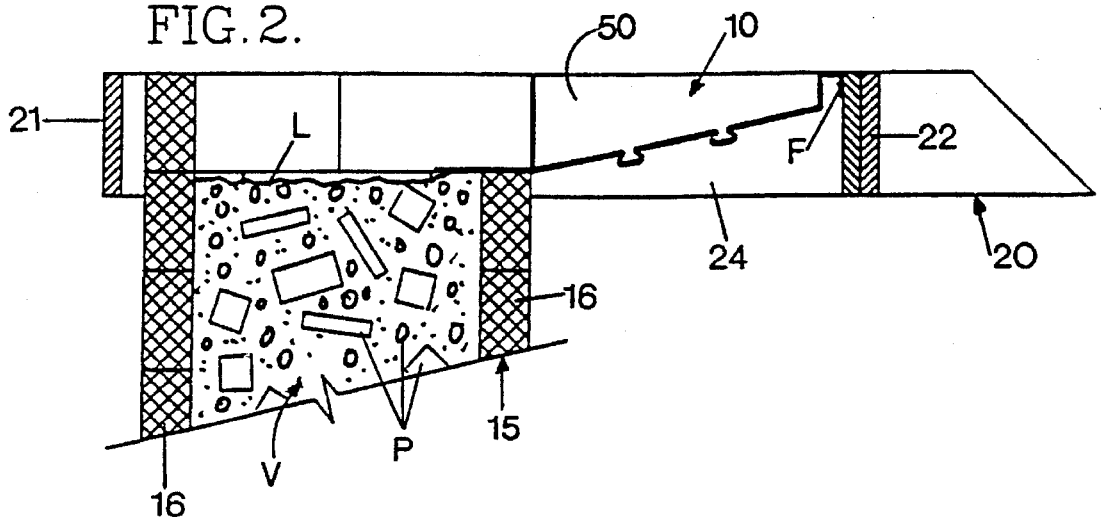
FIG. 2 is a cross-sectional view taken generally along line 2—2 of FIG. 1, and illustrates the hearth form prior to concrete being poured therein.

The concrete masonry unit 15 is formed of a number of conventional cinder blocks 16 mortared to form a generally polygonal volume V which is subsequently filled to an upper level L (FIGS. 2 and 3) by pieces P of broken brick (brick trash), pieces of masonry, and other noncombustionable type trash material available at typical building sites.

The hearth form 10 (FIG. 4) is formed as a body 30 defined of two separate body portions 31, 32 each formed from substantially fire-proof material, preferably sheet metal of a gauge sufficient to lend rigidity thereto.

The hearth form body portion 31 is defined by a bottom wall 33, an upstanding front wall 34, an upstanding side wall 35 and an upstanding rear wall 36. Similarly, the hearth form body portion 32 includes a bottom wall 43, an upstanding front wall 44, an upstanding side wall 45 and an upstanding rear wall 46. Portions 37, 47 of the respective bottom walls 33, 43 project rearwardly beyond the respective upstanding rear walls 36, 46. The rear walls 36, 46 are in alignment.

Figure 3:
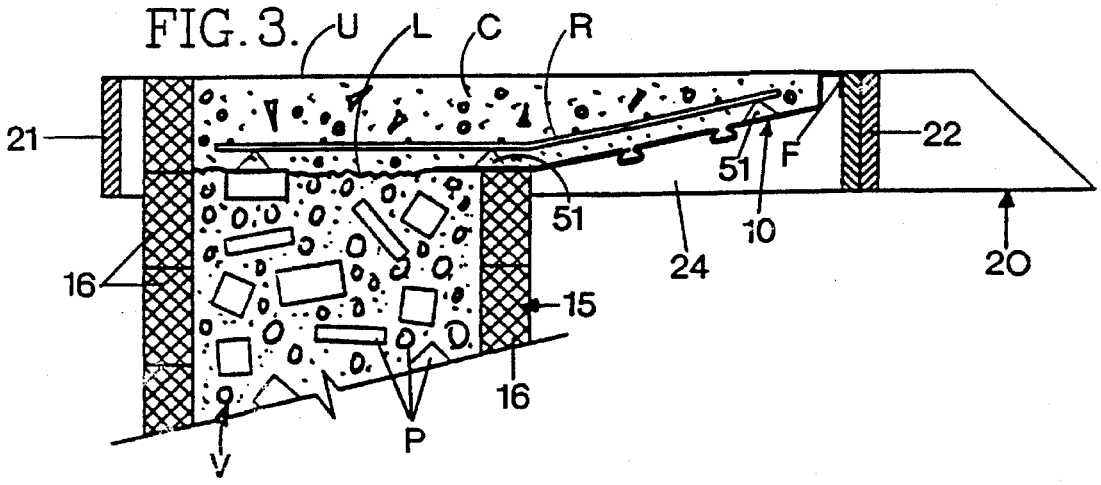
FIG. 3 is a cross-sectional view taken along line 2—2 of FIG. 1, and illustrates the hearth form after rebars have been placed therein and concrete has been poured and set.
Figure 5:
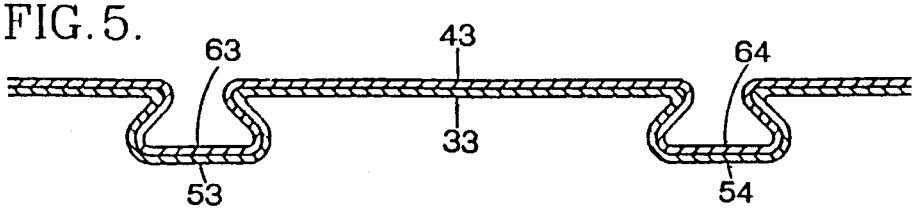
FIG. 5 is an enlarged fragmentary cross-sectional view taken generally along line 5—5 of FIG. 1, and illustrates the slidably inter-engaged channels, slots and/or grooves.

The bottom walls 33, 43 of the hearth form body portions 31, 32, respectively, are provided with two pairs of channels or ribs 53, 54 and 63, 64, respectively, with the channels or ribs 53, 63 and 54, 64 being in interlocked sliding relationship, as is most evident in FIGS. 3 and 5. The latter construction allows the hearth form 10 to be adjusted lengthwise to pour/brm concrete hearths of different sizes. The channels or ribs 53, 54 and 63, 64 extend along the respective side walls 35, 45. Thus, the ribs 53, 54; 63, 64 not only provide relative adjustability between the hearth form body portions 31, 32, but also reinforce the bottom walls 33, 43 and the side walls 35, 45 thereof.

Means generally designated by the reference numerals 70, 75 are provided for spacing the hearth form 10 the desired code distance front the double joists 22–24 and also for suspendingly supporting the same from fasteners, such as nails F (FIG. 2) driven into the innermost joists of the double joists 22–24. The spacing and suspending means 70 are a plurality of identical brackets or hangers, each defined by a horizontal portion 71 and a vertical portion 72. The suspension and spacing means 75 is similarly defined as a hanger or bracket having a horizontal portion 76 and a vertical portion 77. The horizontal portions 71 of the brackets 70 have means 80 which define a nail centering mark and a plurality of like nail centering mark means 80 are formed on the horizontal portion 76 of the hanger or bracket 75. The purpose and function of the nail centering marks 80 will be described more fully hereinafter. Similarly, each of the vertical portions 72 of the brackets or hangers 70 includes downwardly divergingly opening notches 85 defining means for suspending the hearth form 10 from the fasteners F, and a plurality of like notches 85 are formed in the vertical portion 77 of the bracket or hanger 75.

Installation and Operation

After the opening 30 (FIG. 1) defined by the floor joists 21–24 and the concrete masonry unit 15 has been formed, the hearth form 10 is assembled to the position shown in FIG. 4 by sliding together the channels or ribs 53, 54 and 63, 64 of the body portions 31, 32, respectively. The hearth form 10 is then positioned generally in the manner shown in FIG. 1 with the rear walls 36, 46 engaging end faces (unnumbered) of respective cinder blocks B1, B2 of the tipper course of the concrete masonry unit 15. Due to the fact that the distance between the end faces (unnumbered) of the cinder blocks B1, B2 to the inside surface (unnumbered) of the double floor joists 22 is predetermined and built to size, the hearth form 10 fits relatively accurately between the cinder blocks B1, B2 and the double floor joists 22. Preferably, the distance between the side double floor joists 23, 24 is also accurately built, but if not the hearth form bodies or body portions 31, 32 can be slid relative to each other for adjusting purposes. However, the primary purpose of this relative sliding movement is to accommodate the hearth form 10 for larger or smaller hearths so that a single hearth form 10 can be purchased by a builder and utilized for whatever hearth size is eventually to be built. However, no matter the size of the opening 30 or the eventually formed hearth, the hearth form 10 is positioned such that the vertical portions 72 of the suspension and spacing hangers or brackets 70, 75 contact the inner surfaces of the associated floor joists 22–24. The workmen then scribes or marks the upper surfaces (unnumbered) of the floor joists 22–24 in alignment with the nail centering mark means or nail centering marks 80, as is indicated at L1 in FIG. 1. The hearth form 10 is then lifted out of the opening 30 and the nails or fasteners F (FIGS. 2 and 3) are driven horizontally into the innermost joists of the double floor joists 22–24 in vertical alignment with the marks L1 a distance vertically downwardly corresponding to the distance between the horizontal portions 71, 76 and the blind ends (unnumbered) of the notches 85. In this fashion, there will be a fastener F associated with each of the hearth form suspending means or notches 85 with the fasteners F all being in a common horizontal plane. When the fasteners F have been driven home, the hearth form 10 is repositioned in the opening 30 with each notch 85 receiving and resting upon a fastener F. This positions the upper horizontal portions 71, 76 of the respective brackets 70, 75 co-planar to the upper surfaces (unnumbered) of the double floor joists 22–24. The rear portions 37, 47 of the respective bottom walls 33, 43 of the respective hearth form bodies 31, 32 are supported upon the upper surfaces (unnumbered) of underlying cinder blocks (unnumbered) of the second lowermost course of cinder blocks, as is most evident in FIGS. 2 and 3 of the drawings. Thereafter reinforcing bars or rebars R (FIG. 3) are placed upon the hearth form 10 within a generally upwardly opening cavity or chamber 50 defined by the walls 34–36 and 44–46 of the respective hearth form bodies 31, 32 (FIG. 3). The rebar R is supported upon conventional supports or chairs 51 (FIG. 3). Thereafter, concrete C is poured into the cavity 50 and the concrete masonry unit 15 above the tipper level L of the brick trash and/or masonry fill until the cavity 50 is essentially filled. An upper surface U of the concrete C is trawled smooth and the concrete eventually sets. Since the hearth form 10 is constructed from substantially fire-proof material, it need not be removed and simply remains in the position shown in FIG. 3 with the eventual hearth being thereafter completed.

It should be particularly noted that the space S1 between the hearth form 10 and the associated floor double joists 22–24 is maintained accurately within whatever might be the code parameters of a particular installation, and the latter is achieved by simply forming the horizontal portions 71, 76 of the respective suspension and spacing hangers 70, 75, respectively, to the distance required by the code. Just as importantly, since the hearth form 10 accurately fits the opening 30, there are no gaps or spaces formed anywhere between the set concrete C and any of the remaining structure, and conventional heat-transfer openings, channels or fissures found in conventional wood-built hearth forms are totally eliminated.

The hearth form 10 thereby reflects an extremely efficient, low cost and safe structure for manufacturing fireplace hearths of a variety of sizes and shapes depending upon the dictates of regional and national codes and the desires of homeowners, purchasers and/or builders.

Although a preferred embodiment of the invention has been specifically illustrated and described herein, it is to be understood that minor variations may be made in the apparatus without departing from the spirit and scope of the invention, as defined the appended claims.

I claim:

1. A hearth form for pour-forming a fireplace hearth comprising a body constructed from substantially fire-proof material, said body defining a chamber into which concrete can be poured, means for securing said body in spaced relationship to associated floor structure defining an opening within which the fireplace hearth is to be pour-formed, said body being constructed from at least two body portions to effect size adjustment for accommodating the hearth form to different sizes of floor structure openings thereby selectively pour-forming fireplace hearths of different sizes, means for effecting slidable adjusting movement between said body portions, and said slidable adjustment movement effecting means include a rib of one body portion in sliding relationship to a groove of another of said body portions.

2. The hearth form as defined in claim 1 including means for reinforcing said body to reduce deflection caused by the weight of poured concrete.

3. The hearth form as defined in claim 1 wherein said body includes means for indicating the locations at which fasteners are to be placed in the associated floor structure to accurately locate said hearth form within the floor structure opening.

4. The hearth form as defined in claim 1 wherein said securing means include means for suspending said body from fasteners located in the associated floor structure.

5. The hearth form as defined in claim 1 wherein said securing means include means for suspending said body from fasteners located in the associated floor structure, and said suspending means include a plurality of suspension brackets projecting generally outwardly of a peripheral portion of said body.

6. A hearth form for pour-forming a fireplace hearth comprising a body constructed from substantially fire proof material, said body defining a chamber into which concrete can be poured, means for securing said body in spaced relationship to associated floor structure defining an opening within which the fireplace hearth is to be pour-formed, means for reinforcing said body to reduce deflection caused by the weight of poured concrete, and said reinforcing means is defined by at least one reinforcing rib running along a bottom wall of said body and continuing along opposite side walls of said body.

7. The hearth form as defined in claim 6 wherein said body includes means for indicating the locations at which fasteners are to be placed in the associated floor structure to accurately locate said hearth form within the floor structure opening.

8. The hearth form as defined in claim 6 wherein said securing means include means for suspending said body from fasteners located in the associated floor structure.

9. The hearth form as defined in claim 6 wherein said securing means include means for suspending means include a plurality of suspension brackets projecting generally outwardly of a peripheral portion of said body.

10. A fireplace hearth comprising a floor structure defining an opening, a hearth form located within said opening, said hearth form comprising a body constructed of substantially fire-proof material, said body defining a chamber, solidified concrete within said chamber, means for securing said body in spaced relationship to said floor structure, said floor structure including at least one floor joist defining a portion forward of the fireplace hearth, and said securing means secure a forward portion of said hearth form in substantially spaced relationship to said one floor joist.

11. The fireplace hearth as defined in claim 10 wherein said body is constructed from at least two body portions to effect size adjustment for accommodating the hearth form to different sizes of floor structure openings thereby selectively pour-forming fireplace hearths of different sizes.

12. The fireplace hearth as defined in claim 10 including means for reinforcing said body to reduce deflection caused by the weight of the solidified concrete.

13. The fireplace hearth as defined in claim 10 wherein said body includes means for indicting the location at which fasteners are placed in the at least one floor joist to accurately locate said hearth form within said opening.

14. The fireplace hearth as defined in claim 10 wherein said securing means includes means for suspending said body from fasteners located in said at least one floor joist.

15. The fireplace hearth as defined in claim 10 wherein said securing means include means for suspending said body from fasteners located in said at least one floor joist and said suspending means include a plurality of suspension brackets projecting generally outwardly of a peripheral portion of said body.

16. The fireplace hearth as defined in claim 10 including side floor joists located in space relationship to each other, each side floor joist being in spaced adjacent relationship to a side portion of said hearth form, and said securing means.

17. The fireplace hearth as defined in claim 16 wherein said body is constructed from at least two body portions to effect size adjustment for accommodating the hearth form to different sizes of floor structure opening thereby selectively pour-forming fireplace hearths of different sizes.

18. The fireplace hearth as defined in claim 16 including means for reinforcing said body to reduce deflection caused by the weight of the solidified concrete.

19. The fireplace hearth as defined in claim 16 wherein said body includes means for indicating the locations at which fasteners are placed in the at least one floor joist to accurately locate said hearth form within said opening.

20. The fireplace hearth as defined in claim 16 wherein said securing means includes means for suspending said body from fasteners located in said side floor joints.

21. The fireplace hearth as defined in claim 16 wherein said securing means include means for suspending said body from fasteners located in said side floor joists, and said suspending means include a plurality of suspension brackets projecting generally outwardly of a peripheral portion of said body.

22. A fireplace hearth comprising a floor structure defining an opening, a hearth form located within said opening, said hearth form comprising a body constructed of substantially fire-proof material, said body defining a chamber, solidified concrete within said chamber, means for securing said body in spaced relationship to said floor structure, said floor structure including at least one floor joist defining a portion forward of the fireplace hearth, and said securing means secure a forward portion of said hearth form in substantially spaced parallel relationship to said one floor joist.

23. A fireplace hearth comprising a floor structure defining an opening, a hearth form located within said opening, said hearth form comprising a body constructed of substantially fire-proof material, said body defining a chamber, solidified concrete within said chamber, means for securing said body in spaced relationship to said floor structure, said floor structure including a pair of spaced side floor joists located one at each of opposite side portions of the fireplace hearth, and said securing means secure side portions of said hearth form each in substantially space relationship to an associated one of said side floor joists.

24. A fireplace hearth comprising a floor structure defining an opening, a hearth form located within said opening, said body defining a chamber, solidified concrete within said chamber, means for securing said body in spaced relationship to said floor structure, said floor structure including a pair of spaced side floor joists located one at each of opposite side portions of the fireplace hearth, and said securing means secure side portions of said hearth form each in substantially spaced parallel relationship to an associated one of said side floor joists.

25. A fireplace hearth comprising a floor structure defining an opening, a hearth form located within said opening, said hearth form comprising a body constructed of substantially fire-proof material, said body defining a chamber, solidified concrete within said chamber, means for securing said body in spaced relationship to said floor structure, said floor structure including at least one floor joist defining a portion forward of the fireplace hearth in spanning relationship to and substantially between a pair of spaced side floor joists located one at each of opposite side portions of the fireplace hearth, and said securing means secure a forward portion of said hearth form in substantially spaced relationship to said one floor joist and secure side portions of said hearth form each in substantially spaced relationship to an associated one of said side floor joists.

26. A fireplace hearth comprising a floor structure defining an opening, a hearth form located within said opening, said hearth form comprising a body constructed of substantially fire-proof material, said body defining a chamber, solidified concrete within said chamber, means for securing said body in spaced relationship to said floor structure, said floor structure includes at least one floor joist defining a portion forward of the fireplace hearth in spanning relationship to and substantially between a pair of spaced side floor joists located one at each of opposite side portions of the fireplace hearth, and said securing means secure a forward portion of said hearth form in substantially spaced parallel relationship to said one floor joist and secure side portions of said hearth form each in substantially spaced parallel relationship to an associated one of said side floor joists.

27. A fireplace hearth comprising a floor structure defining an opening, a hearth form located within said opening, said hearth form comprising a body constructed of substantially fire-proof material, said body defining a chamber, solidified concrete within said chamber, means for securing said body in spaced relationship to said floor structure, said body being constructed from at least two body portions to effect size adjustment for accommodating the hearth form to different sizes of floor structure openings thereby selectively pour-forming fireplace hearths of different sizes, means for adjustment movement effecting means include a rib of one body portion in sliding relationship to a groove of another of said body portions.

* * * * *